US009489964B2

(12) United States Patent
Kovesi et al.

(10) Patent No.: US 9,489,964 B2
(45) Date of Patent: Nov. 8, 2016

(54) EFFECTIVE PRE-ECHO ATTENUATION IN A DIGITAL AUDIO SIGNAL

(71) Applicant: Orange, Paris (FR)

(72) Inventors: Balazs Kovesi, Lannion (FR); Stephane Ragot, Lannion (FR)

(73) Assignee: ORANGE, Paris (FR)

( * ) Notice: Subject to any disclaimer, the term of this patent is extended or adjusted under 35 U.S.C. 154(b) by 3 days.

(21) Appl. No.: 14/411,790

(22) PCT Filed: Jun. 28, 2013

(86) PCT No.: PCT/FR2013/051517

§ 371 (c)(1),
(2) Date: Dec. 29, 2014

(87) PCT Pub. No.: WO2014/001730

PCT Pub. Date: Jan. 3, 2014

(65) Prior Publication Data

US 2015/0170668 A1 Jun. 18, 2015

(30) Foreign Application Priority Data

Jun. 29, 2012 (FR) ..... 12 56285

(51) Int. Cl.
*G10L 21/0364* (2013.01)
*G10L 19/26* (2013.01)
*G10L 19/025* (2013.01)

(52) U.S. Cl.
CPC ..... *G10L 21/0364* (2013.01); *G10L 19/26* (2013.01); *G10L 19/025* (2013.01)

(58) Field of Classification Search
CPC ..... G10L 21/0364; G10L 19/26
USPC ..... 375/130, 342; 379/406.03; 380/28; 381/66, 104; 700/94; 704/201, 203, 704/226, 219, 225; 341/50
See application file for complete search history.

(56) References Cited

U.S. PATENT DOCUMENTS 5,311,549 A * 5/1994 Mahieux ..... H04B 1/66 341/200
5,731,767 A * 3/1998 Tsutsui ..... G10L 19/0212 341/50

(Continued)

OTHER PUBLICATIONS

International Search Report and Written Opinion dated Sep. 23, 2013 for corresponding International Application No. PCT/FR2013/051517, filed Jun. 28, 2013.

(Continued)

*Primary Examiner* — Gerald Gauthier
(74) *Attorney, Agent, or Firm* — David D. Brush; Westman, Champlin & Koehler P.A

(57) ABSTRACT

A method is provided for processing pre-echo attenuation in a digital audio signal generated from a transform coding, wherein, at the decoding point, the method includes: detection of a position of attack in the decoded signal; determination of a pre-echo region preceding the position of attack detected in the decoded signal; calculation of attenuation factors per sub-block of the pre-echo region, according to at least the frame wherein the attack has been detected and the preceding frame; and pre-echo attenuation in the sub-blocks of the pre-echo region by the corresponding damping factors. The method also includes application of a filter for the spectral shaping of the pre-echo region on the current frame up to the detected position of the attack. A device and a decoder including the device are also proved for implementing the method.

12 Claims, 12 Drawing Sheets

(56) References Cited

U.S. PATENT DOCUMENTS

| | | | | |
|---|---|---|---|---|
| 5,752,224 | A * | 5/1998 | Tsutsui | G10L 19/035 381/102 |
| 5,901,234 | A * | 5/1999 | Sonohara | H03G 9/025 381/104 |
| 5,974,379 | A * | 10/1999 | Hatanaka | G10L 19/025 704/224 |
| 7,443,978 | B2 * | 10/2008 | Isaka | G10L 19/18 379/406.03 |
| 7,561,688 | B2 * | 7/2009 | Van Der Veen | G10L 19/018 380/28 |
| 7,760,790 | B2 * | 7/2010 | Baum | G10L 19/018 358/3.28 |
| 8,676,365 | B2 * | 3/2014 | Kovesi | G10L 19/26 370/503 |
| 8,756,054 | B2 * | 6/2014 | Kovesi | G10L 19/24 704/203 |
| 9,020,815 | B2 * | 4/2015 | Gao | G10L 19/022 704/205 |
| 2009/0313009 | A1 * | 12/2009 | Kovesi | G10L 19/24 704/203 |
| 2011/0178617 | A1 * | 7/2011 | Kovesi | G10L 19/26 700/94 |
| 2014/0303965 | A1 * | 10/2014 | Lee | G10L 19/002 704/201 |
| 2015/0170668 | A1 * | 6/2015 | Kovesi | G10L 19/26 381/66 |
| 2015/0348561 | A1 * | 12/2015 | Kovesi | G10L 19/012 704/226 |

OTHER PUBLICATIONS

"G.729 Based Embedded Variable Bit-Rate Coder: An 8-32 kbit/s scalable wideband coder bitstream interoperable with G.729; G.729.1 (05/06)" ITU-T Draft Study Period 2005-2008, International Telecommunication Union, Geneva; CH, No. G7.29.1 (05/06), May 29, 2006, XP017404590.

English translation of the International Written Opinion dated Dec. 29, 2014 for corresponding International Application No. PCT/FR2013/051517, filed Jun. 28, 2013.

* cited by examiner

EFFECTIVE PRE-ECHO ATTENUATION IN A DIGITAL AUDIO SIGNAL

CROSS-REFERENCE TO RELATED APPLICATIONS

This application is a Section 371 National Stage Application of International Application No. PCT/FR2013/051517, filed Jun. 28, 2013, the content of which is incorporated herein by reference in its entirety, and published as WO 2014/001730 on Jan. 3, 2014, not in English.

FIELD OF THE DISCLOSURE

The invention relates to a method and a device for processing attenuation of pre-echoes during the decoding of a digital audio signal.

For the transport of digital audio signals over transmission networks, be they for example fixed or mobile networks, or for the storage of signals, use is made of compression (or source coding) processes implementing coding systems of the transform-based frequency coding or temporal coding type.

Thus the field of application of the method and device, which are the subject of the invention, is the compression of sound signals, in particular of digital audio signals coded by frequency transform.

BACKGROUND OF THE DISCLOSURE

FIG. 1 represents by way of illustration, a basic diagram of the transform-based coding and decoding of a digital audio signal including an analysis-synthesis by addition/overlap according to the prior art.

Certain musical sequences, such as percussions and certain speech segments such as the plosives (/k/, /t/, . . . ), are characterized by extremely abrupt attacks which are manifested by very fast transitions and a very strong variation of the dynamics of the signal within the space of a few samples. An exemplary transition is given in FIG. 1 onwards of sample 410.

For the coding/decoding processing, the input signal is split up into blocks of samples of length L, represented in FIG. 1 by dotted vertical lines. The input signal is denoted x(n), where n is the index of the sample. The slicing into successive blocks leads to the blocks being defined by $X_N(n)=[x(N\cdot L) \ldots x(N\cdot L+L-1)]=[x_N(0) \ldots x_N(L-1)]$, where N is the index of the frame, and L is the length of the frame. In FIG. 1 we have L=160 samples. In the case of the modified cosine modulated transform MDCT (for "Modified Discrete Cosine Transform"), two blocks $X_N(n)$ and $X_{N+1}(n)$ are analyzed jointly to give a block of transformed coefficients associated with the frame of index N.

The division into blocks, also called frames, operated by the transform-based coding is totally independent of the sound signal and the transitions can therefore appear at any point of the analysis window. Now, after transform-based decoding, the reconstructed signal is marred by "noise" (or distortion) engendered by the quantization (Q)-inverse quantization ($Q^{-1}$) operation. This coding noise is distributed temporally in a relatively uniform manner over the whole of the temporal support of the transformed block, that is to say over the whole length of the window of length 2 L of samples (with overlap of L samples). The energy of the coding noise is in general proportional to the energy of the block and is dependent on the coding/decoding bitrate.

For a block comprising an attack (such as the block 320-480 of FIG. 1) the energy of the signal is high, the noise is therefore also of high level.

In transform-based coding, the level of the coding noise is typically below that of the signal for the high-energy segments which immediately follow the transition, but the level is above that of the signal for the segments of lower energy, especially over the part preceding the transition (samples 160-410 of FIG. 1). For the aforementioned part, the signal-to-noise ratio is negative and the resulting degradation can appear very annoying during listening. The coding noise prior to the transition is called pre-echo and the noise posterior to the transition is called post-echo.

It may be observed in FIG. 1 that the pre-echo affects the frame preceding the transition as well as the frame where the transition occurs.

Psycho-acoustic experiments have shown that the human ear performs fairly limited, of the order of a few milliseconds, temporal pre-masking of sounds. The noise preceding the attack, or pre-echo, is audible when the duration of the pre-echo is greater than the duration of the pre-masking.

The human ear also performs a post-masking of a longer duration, from 5 to 60 milliseconds, when passing from high-energy sequences to low energy sequences. The rate or level of annoyance which is acceptable for the post-echoes is therefore bigger than for the pre-echoes.

The phenomenon of pre-echoes, which is more critical, is all the more annoying the bigger the length of the blocks in terms of number of samples. Now, in transform-based coding, it is well known that for stationary signals the more the length of the transform increases, the bigger the coding gain. At fixed sampling frequency and fixed bitrate, if the number of points of the window (therefore the length of the transform) is increased, more bits per frame will be available to code the frequency spectral lines deemed useful by the psychoacoustic model, hence the advantage of using blocks of large length. MPEG AAC coding (Advanced Audio Coding), for example, uses a window of large length which contains a fixed number of samples, 2048, i.e. over a duration of 64 ms at a sampling frequency of 32 kHz; the problem of pre-echoes is managed therein by making it possible to switch from these long windows to 8 short windows by way of intermediate (transition) windows, thereby requiring a certain delay on coding to detect the presence of a transition and adapt the windows. The length of these short windows is therefore 8 ms. At low bitrate it is always possible to have an audible pre-echo of a few ms. Switching the windows makes it possible to attenuate the pre-echo but not to remove it. The transform-based coders used for conversational applications such as UIT-T G.722.1, G.722.1C or G.719 often use a window of duration 40 ms at 16, 32 or 48 kHz (respectively) and a frame length of 20 ms. It may be noted that the UIT-T G.719 coder integrates a mechanism for switching windows with transient detection, however the pre-echo is not completely reduced at low bitrate (typically 32 kbit/s).

With the aim of reducing the aforementioned annoying effect of the phenomenon of pre-echoes, various solutions have been proposed at the coder and/or decoder level.

The switching of windows was cited above. Another solution consists in applying an adaptive filtering. In the zone preceding the attack, the reconstructed signal is viewed as the sum of the original signal and of the quantization noise.

A corresponding filtering technique has been described in the article entitled High Quality Audio Transform Coding at 64 kbits, IEEE Trans. on Communications Vol 42, No. 11, November 1994, published by Y. Mahieux and J. P. Petit.

The implementation of such filtering requires the knowledge of parameters, some of which, like the prediction coefficients and the variance of the signal corrupted by the pre-echo, are estimated at the decoder on the basis of the noisy samples. On the other hand, information such as the energy of the original signal can be known only at the coder and must consequently be transmitted. This makes it necessary to transmit additional information, which at constrained bitrate decreases the relative budget allocated to the transform-based coding. When the block received contains an abrupt variation in dynamic, the filtering processing is applied to it.

The aforementioned filtering process does not make it possible to retrieve the original signal, but affords a large reduction in the pre-echoes. However, it requires that the additional parameters be transmitted to the decoder.

Various pre-echo reduction techniques without specific transmission of information have been proposed. For example, a review of the reduction of pre-echoes in the context of hierarchical coding is presented in the article B. Kövesi, S. Ragot, M. Gartner, H. Taddei, "Pre-echo reduction in the ITU-T G.729.1 embedded coder," EUSIPCO, Lausanne, Switzerland, August 2008.

A typical example of a method of attenuating pre-echoes is described in French patent application FR 08 56248. In this example, attenuation factors are determined per sub-block, in the low-energy sub-blocks preceding a sub-block in which a transition or attack has been detected.

The attenuation factor per sub-block g(k) is calculated for example as a function of the ratio R(k) of the energy of the sub-block of highest energy to the energy of the k-th sub-block in question:

$$g(k)=f(R(k))$$

where $f$ is a decreasing function with values between 0 and 1 and k is the sub-block number. Other definitions of the factor g(k) are possible, for example as a function of the energy En(k) in the current sub-block and of the energy En(k−1) in the previous sub-block.

If the variation of the energy with respect to the maximum energy is low, no attenuation is then necessary. The factor g(k) is then fixed at an attenuation value which inhibits attenuation, that is to say 1. Otherwise, the attenuation factor lies between 0 and 1.

In most cases, especially when the pre-echo is annoying, the frame which precedes the pre-echo frame has a homogeneous energy which corresponds to the energy of a segment of low energy (typically, background noise). According to experiment it is not useful nor even desirable that after the pre-echo attenuation processing the energy of the signal should be below the average energy per sub-block of the signal preceding the processing zone (typically that of the previous frame $\overline{En}$ or that of the second half of the previous frame $\overline{En'}$).

For the sub-block k to be processed it is possible to calculate the limit value of the factor $\lim_g(k)$ so as to obtain exactly the same energy as the average energy per sub-block of the segment preceding the sub-block to be processed. This value is of course limited to a maximum of 1 since we are concerned here with the attenuation values. More precisely:

$$\lim_g(k) = \min\left(\sqrt{\frac{\max(\overline{En}, \overline{En'})}{En(k)}}, 1\right)$$

where the average energy of the previous segment is approximated by max ($\overline{En}$, $\overline{En'}$).

The value $\lim_g(k)$ thus obtained serves as lower limit in the final calculation of the sub-block attenuation factor:

$$g(k)=\max(g(k),lim_g(k))$$

The attenuation factors (or gains) g(k) determined per sub-block are thereafter smoothed by a smoothing function applied sample by sample to avoid abrupt variations of the attenuation factor at the boundaries of the blocks.

For example, it is firstly possible to define the gain per sample as a piecewise constant function:

$$g_{pre}(n)=g(k),n=kL', \ldots ,(k+1)L'-1$$

where L' represents the length of a sub-block.

The function is thereafter smoothed according to the following equation:

$$g_{pre}(n):=\alpha g_{pre}(n-1)+(1-\alpha)g_{pre}(n),n=0, \ldots ,L-1$$

with the convention that $g_{pre}(-1)$ is the last attenuation factor obtained for the last sample of the previous sub-block, and $\alpha$ is the smoothing coefficient, typically $\alpha$=0.85.

Other smoothing functions are also possible. Once the factors $g_{pre}(n)$ have been calculated thus, the pre-echo attenuation is carried out on the reconstructed signal of the current frame, $x_{rec}(n)$, by multiplying each sample by the corresponding factor:

$$x_{rec,g}(n)=g_{pre}(n)x_{rec}(n),n=0, \ldots ,L-1$$

where $x_{rec,g}(n)$ is the signal decoded and post-processed by the pre-echo reduction.

FIGS. 2 and 3 illustrate the implementation of the attenuation method as described in the aforementioned patent application of the prior art and as summarized above.

In these examples the signal is sampled at 32 kHz, the length of the frame is L=640 samples and each frame is divided into 8 sub-blocks of K=80 samples.

In part a) of FIG. 2, a frame of an original signal sampled at 32 kHz, is represented. An attack (or transition) in the signal is situated in the sub-block beginning at the index 320. This signal has been coded by a transform-based coder of low-bitrate (24 kbit/s) MDCT type.

In part b) of FIG. 2, the result of the decoding without pre-echo processing is illustrated. It is possible to observe the pre-echo onwards of sample 160, in the sub-blocks preceding the one containing the attack.

Part c) shows the evolution of the pre-echo attenuation factor (continuous line) obtained by the method described in the aforementioned patent application of the prior art. The dashed line represents the factor before smoothing. It is noted here that the position of the attack is estimated around sample 380 (in the block delimited by samples 320 and 400).

Part d) illustrates the result of the decoding after application of the pre-echo processing (multiplication of the signal b) with the signal c)). It is seen that the pre-echo has indeed been attenuated. FIG. 2 also shows that the smoothed factor does not go back to 1 at the moment of the attack, thus implying a decrease in the amplitude of the attack. The perceptible impact of this decrease is very small but can nonetheless be avoided. FIG. 3 illustrates the same example as FIG. 2, in which, before smoothing, the attenuation factor value is forced to 1 for the few samples of the sub-block preceding the sub-block where the attack is situated. Part c) of FIG. 3 gives an example of such a correction.

In this example the factor value 1 has been assigned to the last 16 samples of the sub-block preceding the attack, onwards of the index 364. Thus the smoothing function progressively increases the factor so that it has a value close to 1 at the moment of the attack. The amplitude of the attack is then preserved, as illustrated in part d) of FIG. 3, on the other hand a few pre-echo samples are not attenuated.

In the example of FIG. 3 the pre-echo reduction by attenuation does not make it possible to reduce the pre-echo until as far as the level of the attack, because of the smoothing of the gain.

Another example with the same setting as that of FIG. 3 is illustrated in FIG. 4. This figure represents 2 frames so as to better show the nature of the signal before the attack. Here, the energy of the original signal before the attack is higher (part a)) than in the case illustrated by FIG. 3, and the signal before the attack is audible (samples 0-850). In part b) it is possible to observe the pre-echo on the decoded signal without pre-echo processing in the zone 700-850. According to the procedure for limiting the attenuation explained previously, the energy of the signal of the pre-echo zone is attenuated as far as the average energy of the signal preceding the processing zone. It is observed in part c) that the attenuation factor calculated by taking account of the energy limitation is close to 1 and that the pre-echo is still present in part d) after application of the pre-echo processing (multiplication of the signal b) with the signal c)), despite the fact that the signal has been set to the right level in the pre-echo zone. It is indeed possible to clearly distinguish this pre-echo on the waveform where it is noted that a high-frequency component is superimposed on the signal in this zone.

This high-frequency component is clearly audible and annoying, and the attack is not as sharp (part d) FIG. 4).

The explanation for this phenomenon is the following: in the case of a very abrupt, impulsive attack (as illustrated in FIG. 4) the spectrum of the signal (in the frame containing the attack) is rather white and therefore also contains many high frequencies. Thus the quantization noise is also white and composed of high frequencies, this not being the case for the signal preceding the pre-echo zone. There is therefore an abrupt change in the spectrum from one frame to the other, which results in an audible pre-echo despite the fact that the energy has been set to the right level.

This phenomenon is again represented in FIGS. 5*a* and 5*b* which show respectively the spectrograms of the original signal at 5*a*, corresponding to the signal represented in part a) of FIG. 4 and the spectrogram of the signal with attenuation of pre-echoes according to the prior art, at 5*b*, corresponding to the signal represented in part d) of FIG. 4.

A still audible pre-echo in the part outlined in FIG. 5*b* is clearly noted.

There therefore exists a need for a technique for improved attenuation of pre-echoes on decoding, which makes it possible to also attenuate the undesirable high frequencies or spurious pre-echoes, doing so without any auxiliary information being transmitted by the coder.

SUMMARY

The present invention improves the situation of the prior art.

For this purpose, the present invention deals with a method of processing attenuation of pre-echo in a digital audio signal engendered on the basis of a transform-based coding, in which, on decoding, the method comprises the following steps:

- detection of an attack position in the decoded signal;
- determination of a pre-echo zone preceding the attack position detected in the decoded signal;
- calculation of attenuation factors per sub-block of the pre-echo zone, as a function at least of the frame in which the attack has been detected and of the previous frame;
- attenuation of pre-echo in the sub-blocks of the pre-echo zone by the corresponding attenuation factors. The method is such that it furthermore comprises:
- the application of an adaptive filtering for spectral shaping of the pre-echo zone on the current frame until as far as the detected position of the attack.

Thus, the spectral shaping applied makes it possible to improve the pre-echo attenuation. The processing makes it possible to attenuate the pre-echo components which could persist when implementing the pre-echo attenuation as described in the prior art.

The filtering being applied until as far as the detected position of the attack, it makes it possible to process the attenuation of the pre-echo up until as close as possible to the attack. This therefore compensates for the disadvantage of the echo reduction by temporal attenuation which is limited to a zone which does not extend as far as the position of the attack (margin of 16 samples for example).

This filtering does not require any information originating from the coder.

This pre-echo attenuation processing technique can be implemented with or without knowledge of a signal arising from a temporal decoding and for the coding of a monophonic signal or of a stereophonic signal.

The adaptation of the filtering makes it possible to adapt to the signal and to remove only the annoying spurious components.

The various particular embodiments mentioned hereinafter can be added independently or in combination with one another, to the steps of the above-defined method.

In a particular embodiment, the method furthermore comprises the calculation of at least one decision parameter regarding the filtering to be applied to the pre-echo zone and the adaptation of the coefficients of the filtering as a function of said at least one decision parameter.

Thus, the processing is then applied only when necessary at an adapted filtering level.

In one embodiment, said at least one decision parameter is a measurement of the strength of the detected attack.

The strength of the attack indeed determines the presence of audible high-frequency components in the pre-echo zone. When the attack is abrupt, the risk of having an annoying spurious component in the pre-echo zone is large and the filtering to be implemented according to the invention must then be envisaged.

In a possible mode of calculation of this parameter, the measurement of the strength of the detected attack is of the form:

$P=\max(EN(k), EN(k+1)/\min(EN(k-1),EN(k-2))$ with k, the number of the sub-block in which the attack has been detected and EN(k) the energy of the $k^{th}$ sub-block.

This calculation is of lesser complexity and makes it possible to properly define the strength of the detected attack.

Said at least one decision parameter can also be the value of the attenuation factor in the sub-block preceding that containing the position of the attack.

Indeed, an attack can be considered to be abrupt if this attenuation is appreciable.

In another embodiment, said at least one decision parameter is based on a spectral distribution analysis of the signal of the pre-echo zone and/or of the signal preceding the pre-echo zone.

This makes it possible for example to determine the importance of the high-frequency components in the pre-echo signal and also to know whether these high-frequency components were already present in the signal before the pre-echo zone.

Thus, in the case where high-frequency components were already present before the pre-echo zone, it is not then necessary to perform a filtering to attenuate these high-frequency components, the adaptation of the filtering coefficients is then performed by setting the filtering coefficients to 0 or to a value close to 0.

Thus, the adaptation of the coefficients of the filtering can be performed in a discrete manner as a function of the comparison of at least one decision parameter with a predetermined threshold.

The filtering coefficients can take values predetermined according to a set of values. The smallest set of values being that where only two values are possible, that is to say for example the choice between filtering and no filtering.

In a variant embodiment, the adaptation of the coefficients of the filtering is performed in a continuous manner as a function of said at least one decision parameter.

The adaptation is then more precise and more progressive.

In a particular embodiment, the filtering is zero-phase finite impulse response filtering with transfer function:

$$c(n)z^{-1}+(1-2c(n))+c(n)z$$

with c(n) a coefficient lying between 0 and 0.25.

This type of filtering is of low complexity and moreover allows delay-free processing (the processing stopping before the end of the current frame). By virtue of its zero delay, the filtering can attenuate the high frequencies before the attack without modifying the attack itself.

This type of filtering makes it possible to avoid discontinuities and makes it possible to pass from a non-filtered signal to a filtered signal in a progressive manner.

According to one embodiment, the attenuation step is performed at the same time as the spectral shaping filtering by integrating the attenuation factors into the coefficients defining the filtering.

The present invention is also aimed at a device for processing attenuation of pre-echoes in a digital audio signal engendered on the basis of a transform-based coder, in which, the device associated with a decoder comprises:

- a detection module for detecting an attack position in the decoded signal;
- a determination module for determining a pre-echo zone preceding the attack position detected in the decoded signal;
- a module for calculating attenuation factors per sub-block of the pre-echo zone, as a function at least of the frame in which the attack has been detected and of the previous frame;
- an attenuation module for attenuating the pre-echoes in the sub-blocks of the pre-echo zone by the corresponding attenuation factors. The device is such that it furthermore comprises:
- an adaptive filtering module for performing a spectral shaping of the pre-echo zone on the current frame until as far as the detected position of the attack.

The invention is aimed at a decoder of a digital audio signal comprising a device such as described above.

Finally, the invention is aimed at a computational program comprising code instructions for implementing the steps of the attenuation processing method such as described, when these instructions are executed by a processor.

Finally the invention pertains to a storage medium, readable by a processor, possibly integrated into the processing device, optionally removable, storing a computational program implementing a processing method such as described above.

BRIEF DESCRIPTION OF THE DRAWINGS

Other characteristics and advantages of the invention will be more clearly apparent on reading the following description, given solely by way of nonlimiting example and with reference to the appended drawings in which.

DETAILED DESCRIPTION OF ILLUSTRATIVE EMBODIMENTS

Figure 6:
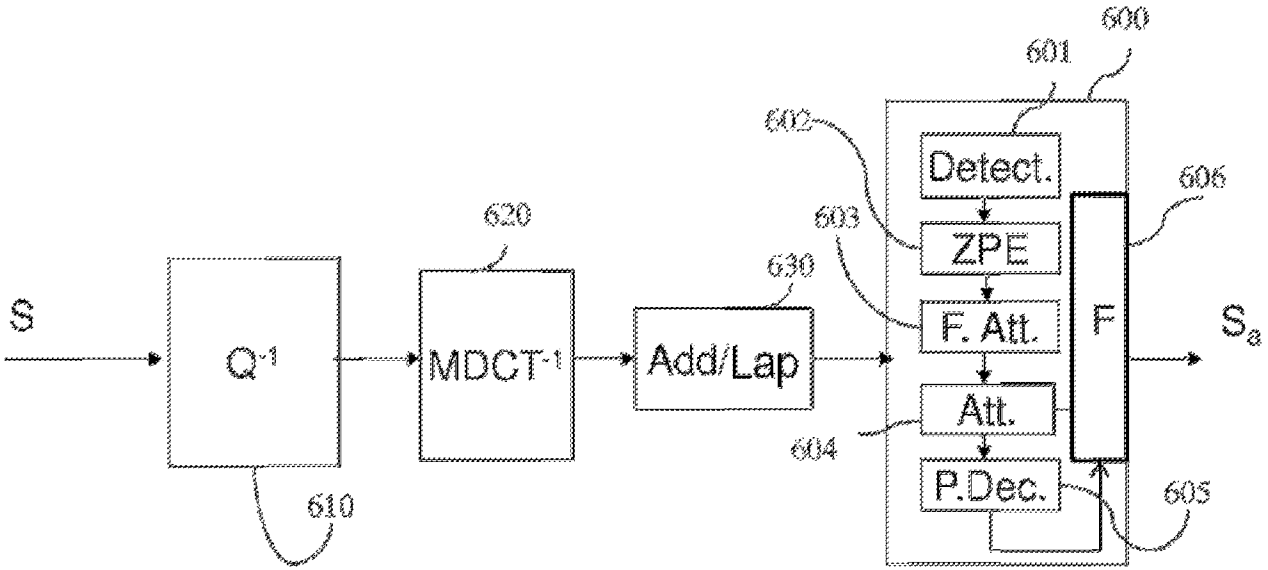
FIG. 6 illustrates a device for processing attenuation of pre-echoes in a digital audio signal decoder, as well as the steps implemented by the processing method according to an embodiment of the invention.

With reference to FIG. 6, a pre-echo attenuation processing device 600 is described. In one embodiment, this device implements a scheme for attenuating the pre-echoes in the decoded signal like for example the scheme described in patent application FR 08 56248. It furthermore implements a filtering for spectral shaping of the pre-echo zone.

Thus, the device 600 comprises a detection module 601 able to implement a step of detection (Detect.) of the position of an attack in a decoded audio signal.

An attack (also known as an onset) is a fast transition and an abrupt variation of the dynamics (or amplitude) of the signal. Signals of this type can be designated by the more general term "transient". Hereinafter and without loss of generality, only the terms attack or transition will be used to designate transients also.

In one embodiment, each frame of L samples of the decoded signal $x_{rec}(n)$ is divided into K sub-blocks of length L', with for example L=640 samples (20 ms) at 32 kHz, L'=80 samples (2.5 ms) and K=8.

Special low-delay analysis-synthesis windows similar to those described in UIT-T standard G.718 are used for the analysis part and for the synthesis part of the MDCT transformation. Thus the MDCT synthesis window contains only 415 non-zero samples in contradistinction to the 640 samples in the case when using conventional sinusoidal windows. In a variant of this embodiment, other analysis/synthesis windows can be used, or switchings between long and short windows can be used.

Figure 1:
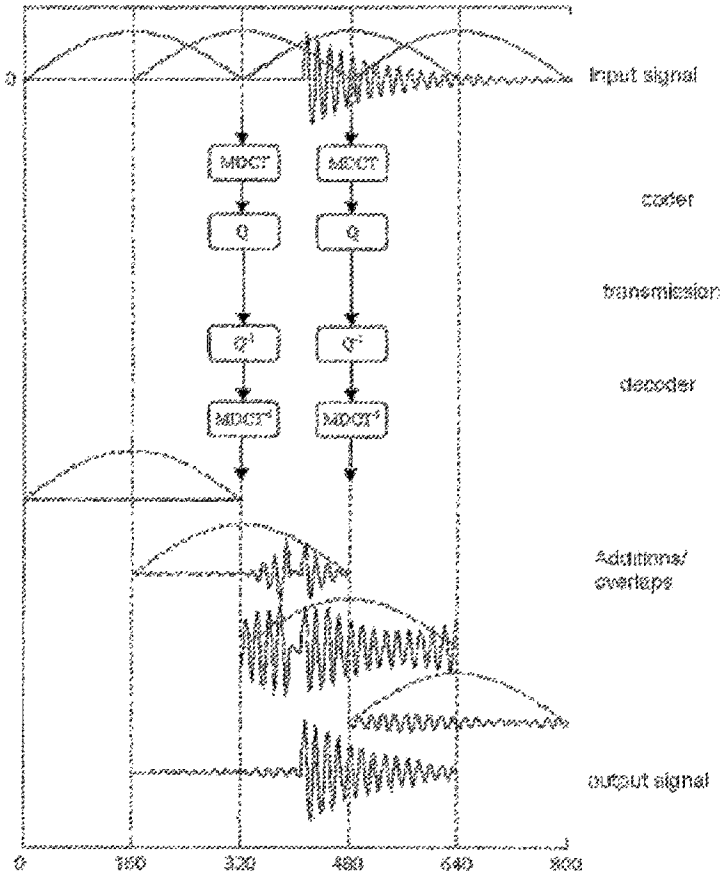
FIG. 1 described previously illustrates a transform-based coding-decoding system according to the prior art.
Figure 2:
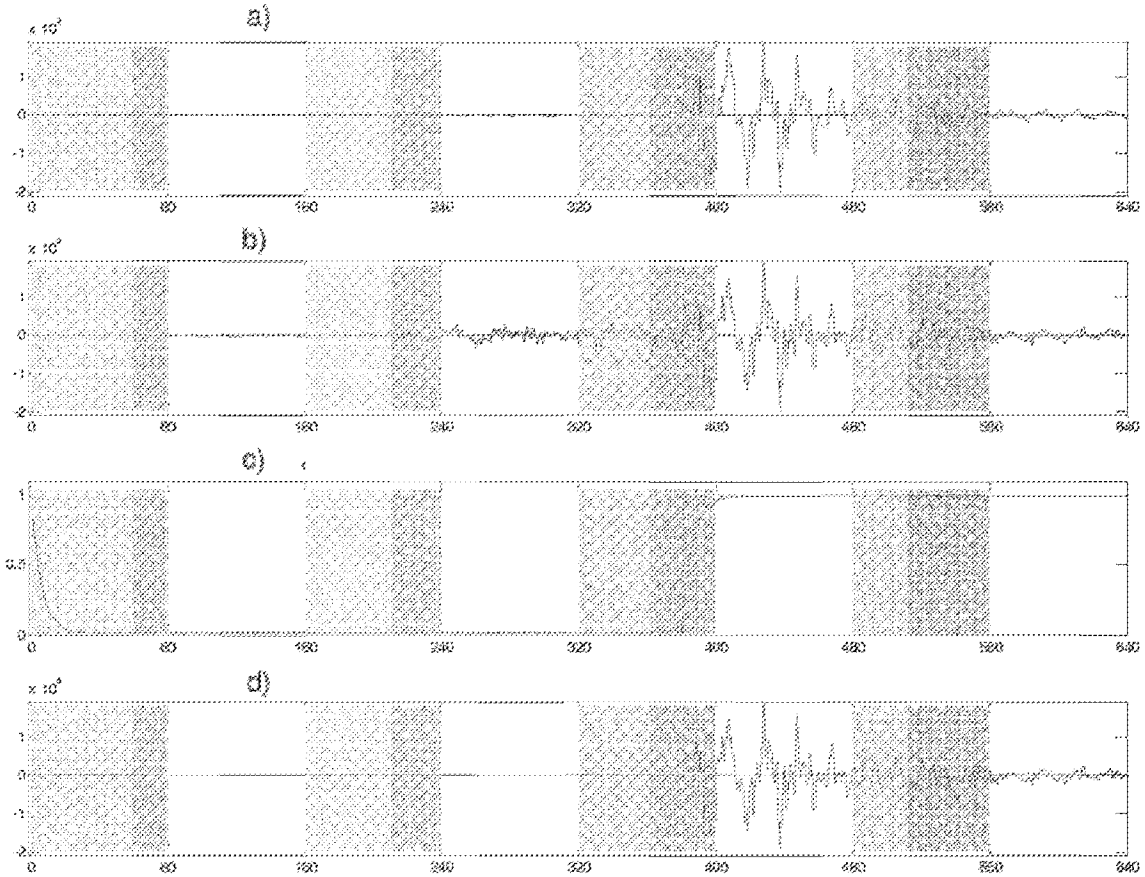
FIG. 2 described previously illustrates an exemplary digital audio signal for which an attenuation scheme according to the prior art is performed.
Figure 3:
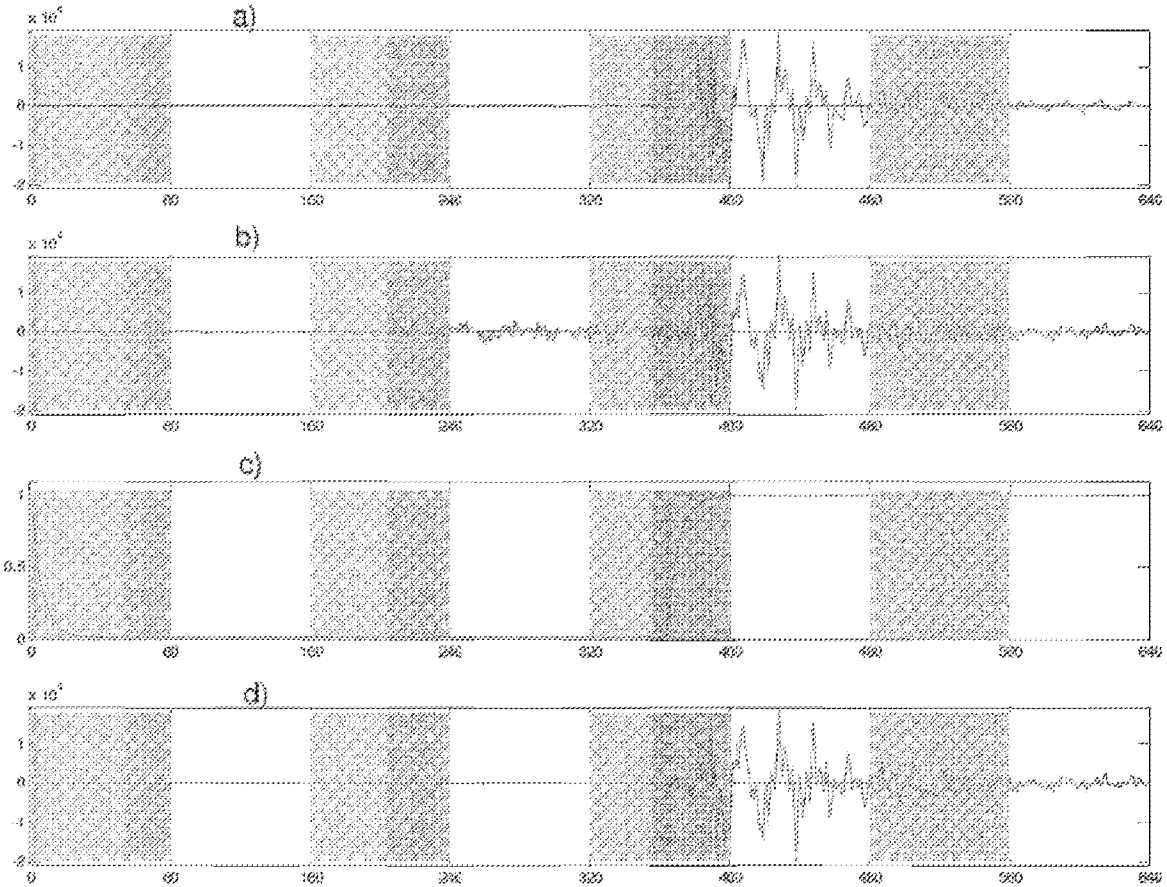
FIG. 3 described previously illustrates another exemplary digital audio signal for which an attenuation scheme according to the prior art is performed.

Moreover, use is made of the MDCT memory $x_{MDCT}(n)$ which gives a version with temporal folding of the future signal. This memory is also divided into sub-blocks of length L' and, depending on the MDCT window used, only the first K' sub-blocks are retained, where K' depends on the window used—for example K'=4 for a sinusoidal window. Indeed, FIG. 1 shows that the pre-echo influences the frame preceding that where the attack is situated, and it is desirable to detect an attack in the future frame which is in part contained in the MDCT memory.

The pre-echo reduction depends here on several parameters:

- The signal decoded in the current frame (which potentially contains pre-echoes) of length L,
- The memory of the MDCT inverse transformation which corresponds to the signal partially decoded in the following frame before addition-overlap.
- The mean energy level in the previous frame (or half-frame).

It may be noted that the signal contained in the MDCT memory includes a temporal folding (which is compensated when the following frame is received). As explained hereinbelow, the MDCT memory serves here essentially to estimate the energy per sub-block of the signal in the following (future) frame and it is considered that this estimation is sufficiently precise for the needs of the pre-echo detection and reduction when it is carried out with the MDCT memory available at the current frame instead of the completely decoded signal at the future frame.

The current frame and the MDCT memory can be viewed as concatenated signals forming a signal of length (K+K')L' split into (K+K') consecutive sub-blocks. Under these conditions, the energy in the k-th sub-block is defined as:

$$En(k) = \sum_{n=kL'}^{(k+1)L'-1} x_{rec}(n)^2,\ k = 0, \ldots, K-1$$

when the k-th sub-block is situated in the current frame and, as:

$$En(k) = \sum_{n=(k-K)L'}^{(k-K+1)L'-1} x_{MDCT}(n)^2,\ k = K, \ldots, K+K'$$

when the sub-block is in the MDCT memory (which represents the signal available for the future frame).

The average energy of the sub-blocks in the current frame is therefore obtained as:

$$\overline{En} = \frac{1}{K}\sum_{k=0}^{K-1} En(k)$$

The average energy of the sub-blocks in the second part of the current frame is also defined as:

$$\overline{En}' = \frac{2}{K}\sum_{k=K/2}^{K-1} En(k)$$

A transition associated with a pre-echo is detected if the ratio $$R(k) = \frac{\max_{k=0,K+K'}(En(k))}{En(k)}$$

exceeds a predefined threshold, in one of the sub-blocks considered. Other pre-echo detection criteria are possible without changing the nature of the invention.

Moreover, it is considered that the position of the attack is defined as $$pos = \min\left(L' \cdot \left(\arg\max_{k=0,K+K'}(En(k))\right), L\right)$$

where the limitation to L ensures that the MDCT memory is never modified. Other schemes for more precise estimation of the position of the attack are also possible.

In variant embodiments with switching of the windows, other schemes giving the position of the attack can be used with a precision ranging from the scale of a sub-block up to a position to within a sample.

The device 600 also comprises a determination module 602 implementing a step of determination (ZPE) of a pre-echo zone preceding the detected attack position.

The energies En(k) are concatenated in chronological order, with firstly the temporal envelope of the decoded signal, and then the envelope of the signal of the following frame estimated on the basis of the memory of the MDCT transform. As a function of this concatenated temporal envelope and of the average energies $\overline{En}$ and $\overline{En}'$ of the previous frame, the presence of pre-echo is detected if the ratio R(k) is sufficiently high.

The sub-blocks in which a pre-echo has been detected thus constitute a pre-echo zone, which in general covers the samples n=0, . . . , pos−1, i.e. from the start of the current frame to the position of the attack (pos).

In variant embodiments, the pre-echo zone does not necessarily begin at the start of the frame, and may involve an estimation of the length of the pre-echo. If switching of windows is used, the pre-echo zone will have to be defined to take into account the windows used.

A module 603 of the device 600 implements a step of calculating attenuation factors per sub-block of the determined pre-echo zone, as a function of the frame in which the attack has been detected and of the previous frame.

In accordance with the description of patent application FR 08 56248, the attenuations g(k) are estimated per sub-block.

The attenuation factor per sub-block g(k) is calculated for example, as a function of the ratio R(k) of the energy of the sub-block of highest energy to the energy of the k-th sub-block in question:

$$g(k)=f(R(k))$$

where $f$ is a decreasing function with values between 0 and 1. Other definitions of the factor g(k) are possible, for example as a function of En(k) and of En(k−1).

If the variation of the energy with respect to the maximum energy is small, no attenuation is then necessary. The factor is then fixed at an attenuation value which inhibits attenuation, that is to say 1. Otherwise, the attenuation factor lies between 0 and 1.

These attenuations are limited as a function of the average energy of the previous frame.

For the sub-block to be processed it is possible to calculate the limit value of the factor $\lim_g(k)$ so as to obtain exactly the same energy as the average energy of the segment preceding the sub-block to be processed. This value is of course limited to a maximum of 1 since we are concerned here with the attenuation values. More precisely:

$$\lim_g(k) = \min\left(\sqrt{\frac{\max(\overline{En}, \overline{En'})}{En(k)}}, 1\right)$$

The value $\lim_g(k)$ thus obtained serves as lower limit in the final calculation of the sub-block attenuation factor:

$$g(k)=\max(g(k),lim_g(k))$$

The attenuation factors g(k) determined per sub-block are thereafter smoothed by a smoothing function applied sample by sample to avoid abrupt variations of the attenuation factor at the boundaries of the blocks.

The gain per sample is firstly defined as a piecewise constant function:

$$g_{pre}(n)=g(k),n=kL', \ldots (k+1)L'-1$$

The smoothing function is for example defined by the following equations:

$$g_{pre}(n):=\alpha g_{pre}(n-1)+(1-\alpha)g_{pre}(n),n=0, \ldots ,L-1$$

with the convention that $g_{pre}(-1)$ is the last attenuation factor obtained for the last sample of the previous sub-block, and $\alpha$ is the smoothing coefficient, typically $\alpha=0.85$.

Other smoothing functions are possible.

The module 604 of the device 600 of FIG. 6 implements the attenuation (Att.) in the sub-blocks of the pre-echo zone, by the attenuation factors obtained.

Thus, once the factors $g_{pre}(n)$ have been calculated, the pre-echo attenuation is carried out on the reconstructed signal of the current frame, $x_{rec}(n)$, by multiplying each sample by the corresponding factor:

$$x_{rec,g}(n)=g_{pre}(n)x_{rec}(n),n=0, \ldots ,L-1$$

where $x_{rec,g}(n)$ is the signal decoded and post-processed for the pre-echo reduction.

The device 600 comprises a filtering module 606 able to perform step (F) of applying a filtering for spectral shaping of the pre-echo zone on the current frame of the decoded signal, until as far as the detected position of the attack.

Typically, the spectral shaping filter used is a linear filter. As the operation of multiplication by a gain is also a linear operation their order can be reversed: it is also possible to firstly carry out the filtering for spectral shaping of the pre-echo zone and then the pre-echo attenuation by multiplying each sample of the pre-echo zone by the corresponding factor.

In an exemplary embodiment the filter used to attenuate the high frequencies in the pre-echo zone is an FIR filter (finite impulse response filter) with 3 coefficients and zero phase with transfer function $c(n)z^{-1}+(1-2c(n))+c(n)z$ with c(n) a value lying between 0 and 0.25, where [c(n),1−2(n), c(n)] are the coefficients of the spectral shaping filter; this filter is implemented with the difference equation:

$$x_{rec,f}(n)=c(n)x_{rec,g}(n-1)+(1-2c(n))x_{rec,g}(n)+c(n)x_{rec,g}(n+1)$$

with for example c(n)=0.25 over the zone n=5, . . . , pos−5.

Figure 7:
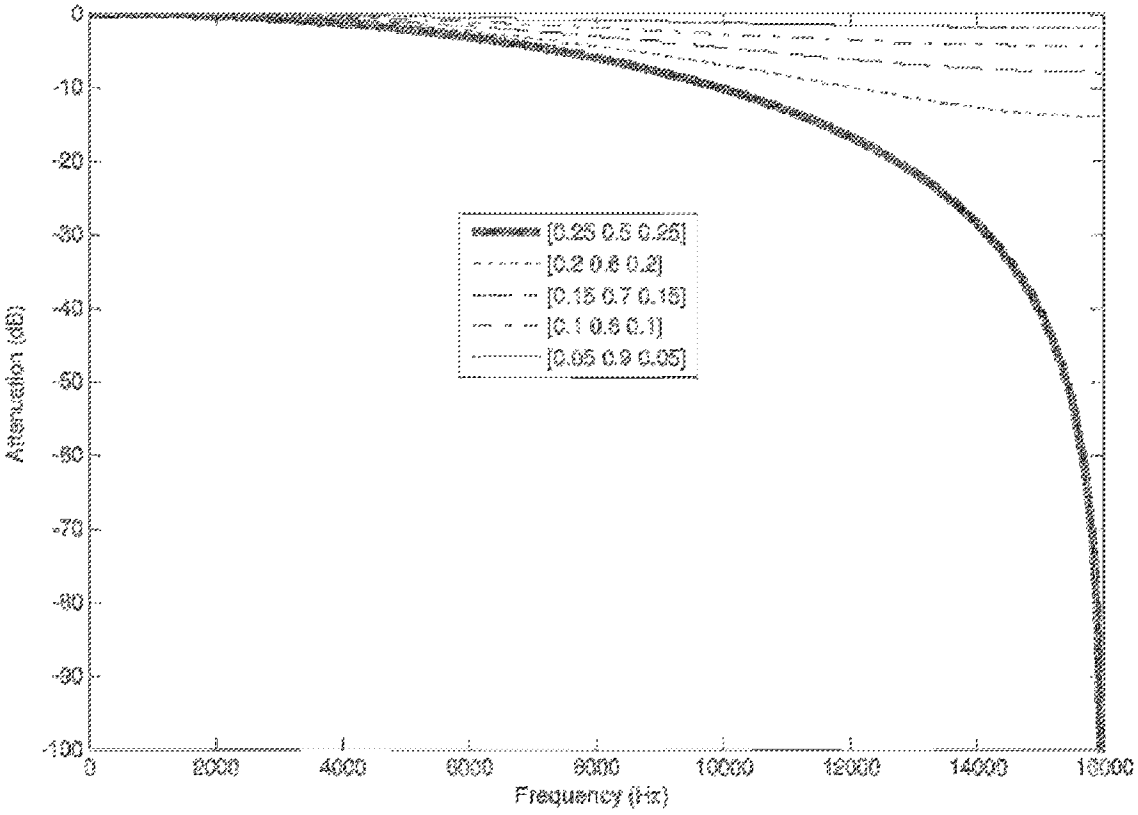
FIG. 7 illustrates the frequency response of a spectral shaping filter implemented according to an embodiment of the invention, as a function of the parameter of the filter.

The frequency response of this filter is illustrated in FIG. 7, as a function of the coefficient c(n), for c(n)=0.05, 0.1, 0.15, 0.2 and 0.25. The motivation to use this filter is its low complexity, its zero phase and therefore its zero delay (possible since the processing stops before the current frame end) but also its frequency response which corresponds well to the low-pass characteristics desired for this filter.

The application of this filter can compensate for the fact that the temporal attenuation of the pre-echo is typically limited to a zone not extending as far as the position of the attack (with a margin of for example 16 samples), whereas the spectral shaping filtering such as defined by the transfer function $c(n)z^{-1}+(1-2c(n))+c(n)z$ can be applied as far as the position of the attack, with optionally a few samples for interpolating the coefficients of the filter.

To pass from a non-filtered signal to a filtered signal and avoid discontinuities it is preferable to introduce the filtering in a progressive manner. The FIR filter proposed makes it possible easily to pass gently from the non-filtered domain to the filtered domain and vice-versa, by slow interpolation or variation of its coefficients. For example, if the position of the attack is pos=16, the filtering of the 16 samples in the pre-echo zone n=0, . . . , pos−1 can be performed in the following manner:

$$x_{rec,f}(0)=x_{rec}(0)$$

$$x_{rec,f}(1)=0.1x_{rec}(0)+0.8x_{rec}(1)+0.1x_{rec}(2)$$

$$x_{rec,f}(2)=0.1x_{rec}(1)+0.8x_{rec}(2)+0.1x_{rec}(3)$$

$$x_{rec,f}(3)=0.15x_{rec}(2)+0.7x_{rec}(3)+0.15x_{rec}(4)$$

$$x_{rec,f}(4)=0.2x_{rec}(3)+0.6x_{rec}(4)+0.2x_{rec}(5)=$$

$$x_{rec,f}(n)=0.25x_{rec}(n-1)+0.5x_{rec}(n)+0.25x_{rec}(n+1),n=5, \ldots ,11$$

$$x_{rec,f}(12)=0.2x_{rec}(11)+0.6x_{rec}(12)+0.2x_{rec}(13)$$

$$x_{rec,f}(13)=0.15x_{rec}(12)+0.7x_{rec}(13)+0.15x_{rec}(14)$$

$$x_{rec,f}(14)=0.1x_{rec}(13)+0.8x_{rec}(14)+0.1x_{rec}(15)$$

$$x_{rec,f}(15)=0.05x_{rec}(14)+0.9x_{rec}(15)+0.05x_{rec}(16)$$

It is observed that, by virtue of its zero delay, the filter $c(n)z^{-1}+(1-2c(n))+c(n)z$ can attenuate the high frequencies before the attack without modifying the attack itself.

Figure 4:
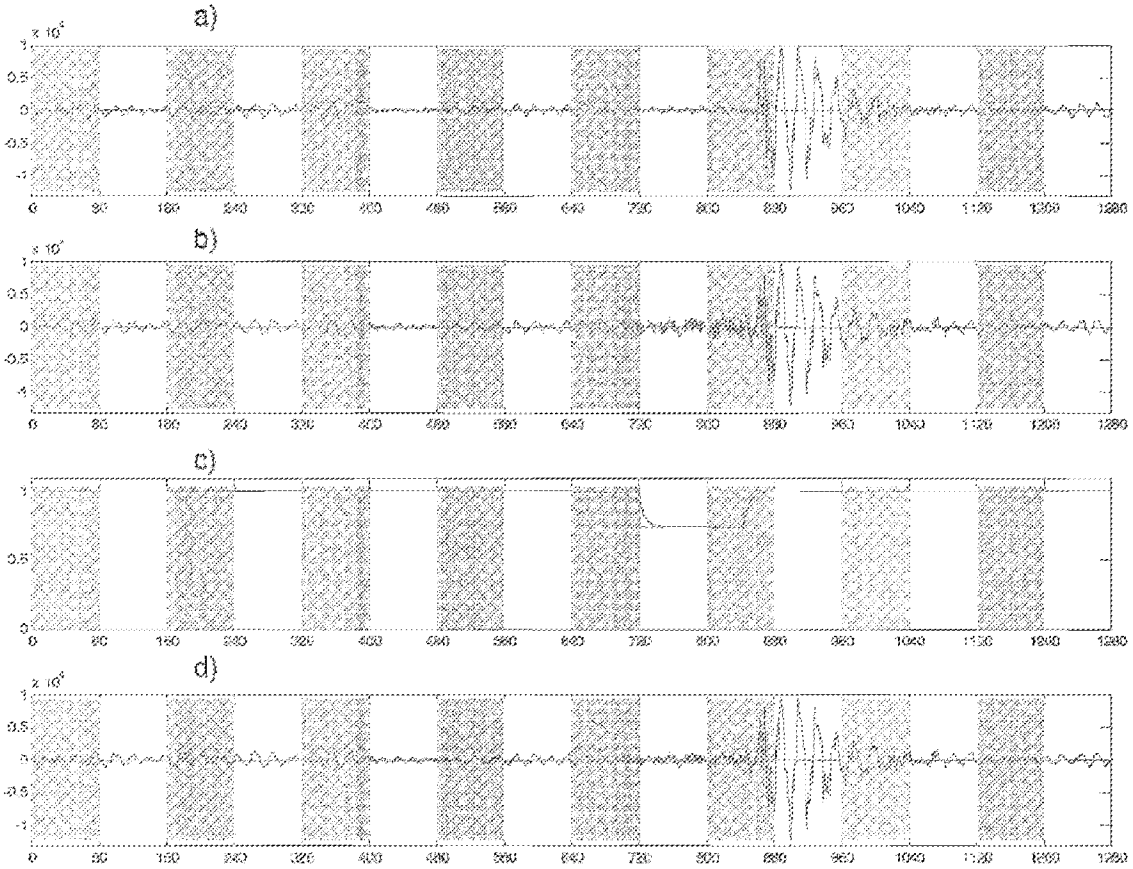
FIG. 4 described previously illustrates yet another exemplary digital audio signal for which an attenuation scheme according to the prior art is performed.
Figure 8:
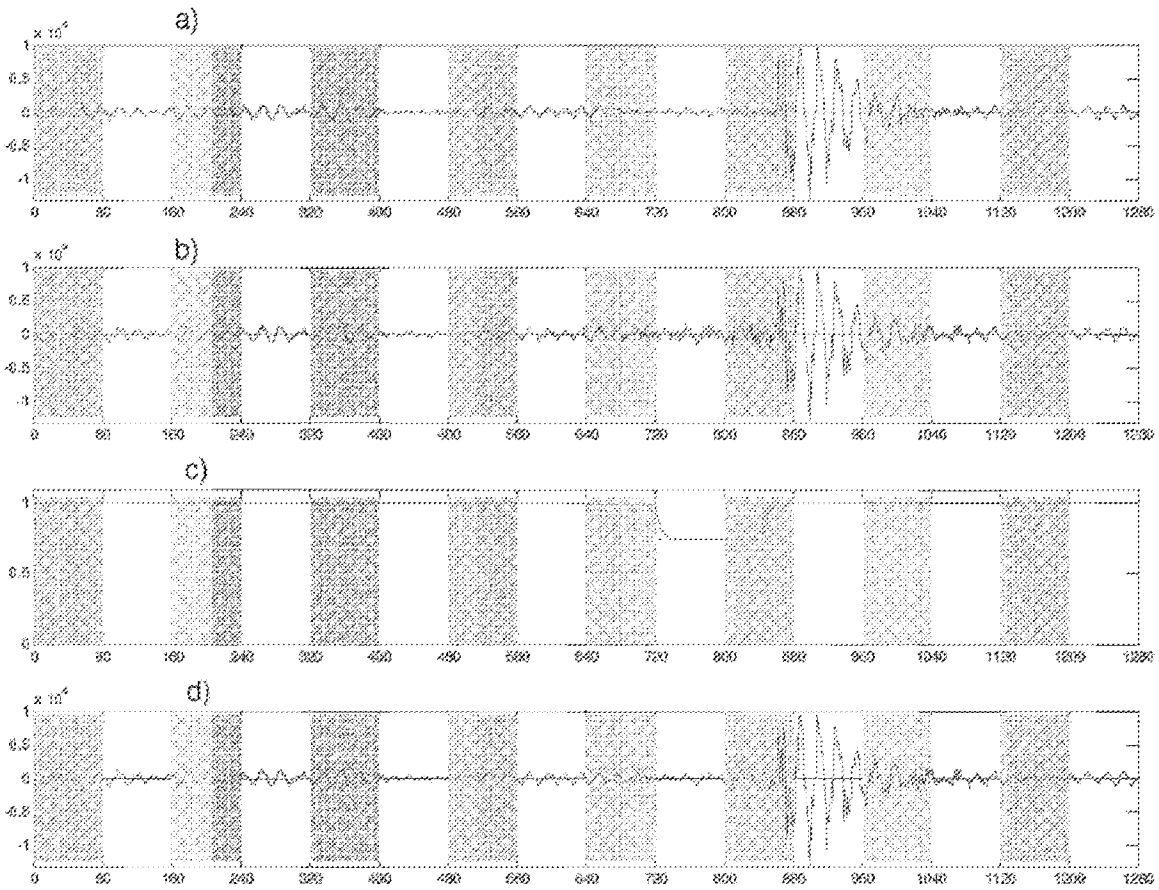
FIG. 8 illustrates an exemplary digital audio signal for which the processing according to the invention has been implemented.

An exemplary digital audio signal, for which the processing as described here is performed, is illustrated in part d) of FIG. 8. Parts a), b) and c) of this figure depict the same signals as those described with reference to FIG. 4 previously. Part d) differs by the implementation of the filtering according to the invention. It may thus be noted that the annoying high-frequency component is greatly decreased, so that the decoded signal after filtering is of better quality than that described in part d) of FIG. 4.

Figure 5A:
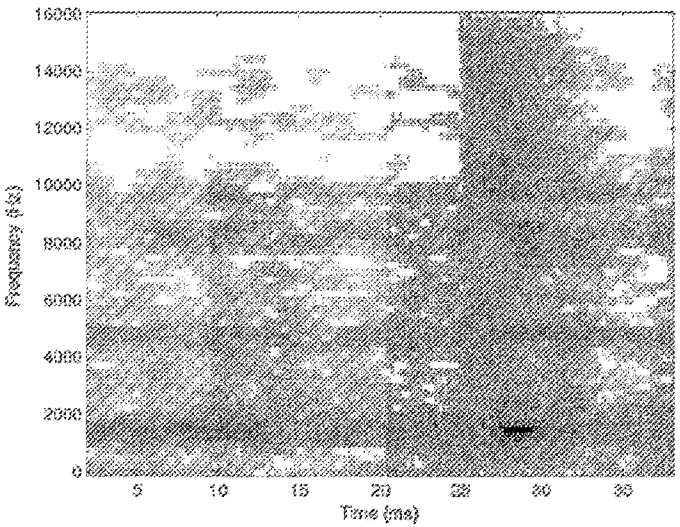
FIGS. 5*a* and 5*b* illustrate respectively the spectrogram of the original signal and the spectrogram of the signal with attenuation of pre-echoes according to the prior art (corresponding respectively to parts a) and d) of FIG. 4)
Figure 5B:
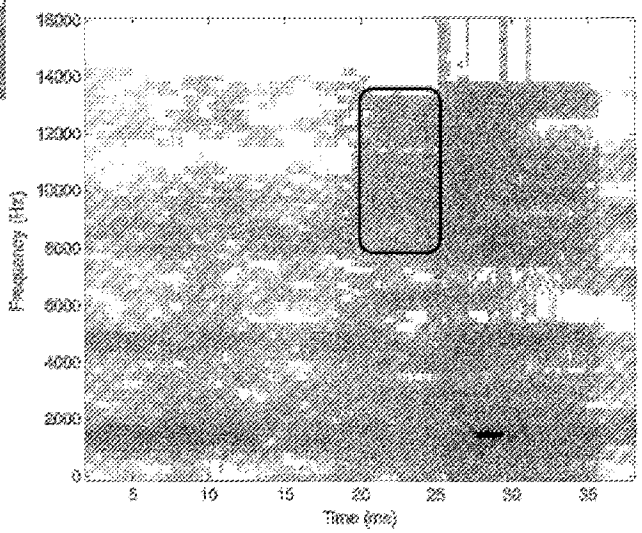
Figure 9:
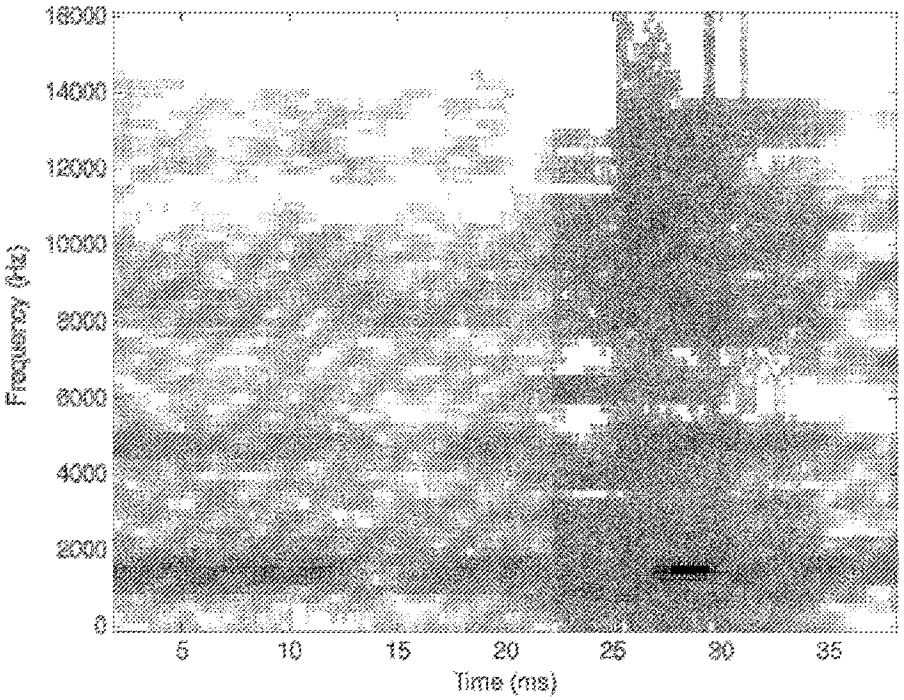
FIG. 9 illustrates the spectrogram of the signal corresponding to the signal d) of FIG. 4, for which the processing according to the invention is implemented.

The spectrogram representing this filtered signal is represented in FIG. 9. The attenuation of the annoying high frequencies before the attack is clearly observed with respect to FIG. 5*b* representing the same signal without shaping filtering. The attack then becomes sharper on decoding.

Of course, other types of spectral shaping filter can be envisaged to replace the filter $c(n)z^{-1}+(1-2c(n))+c(n)z$. For example, it is possible to use an FIR filter of different order or with different coefficients. Alternatively the spectral shaping filter can have infinite impulse response (IIR). Moreover, the spectral shaping can be different from a low-pass filtering, for example a bandpass filter could be implemented.

A filter of order 1, of the form $c(n)z^{-1}+(1-c(n))$ can also be used in an embodiment of the invention.

In a particular embodiment, the filtering implemented according to the method described is an adaptive filtering. It can thus be adapted to the characteristics of the decoded audio signal.

In this embodiment, a step of calculating a decision parameter (P) regarding the filtering to be applied to the pre-echo zone is implemented in the calculation module 605 of FIG. 6.

Figure 10:
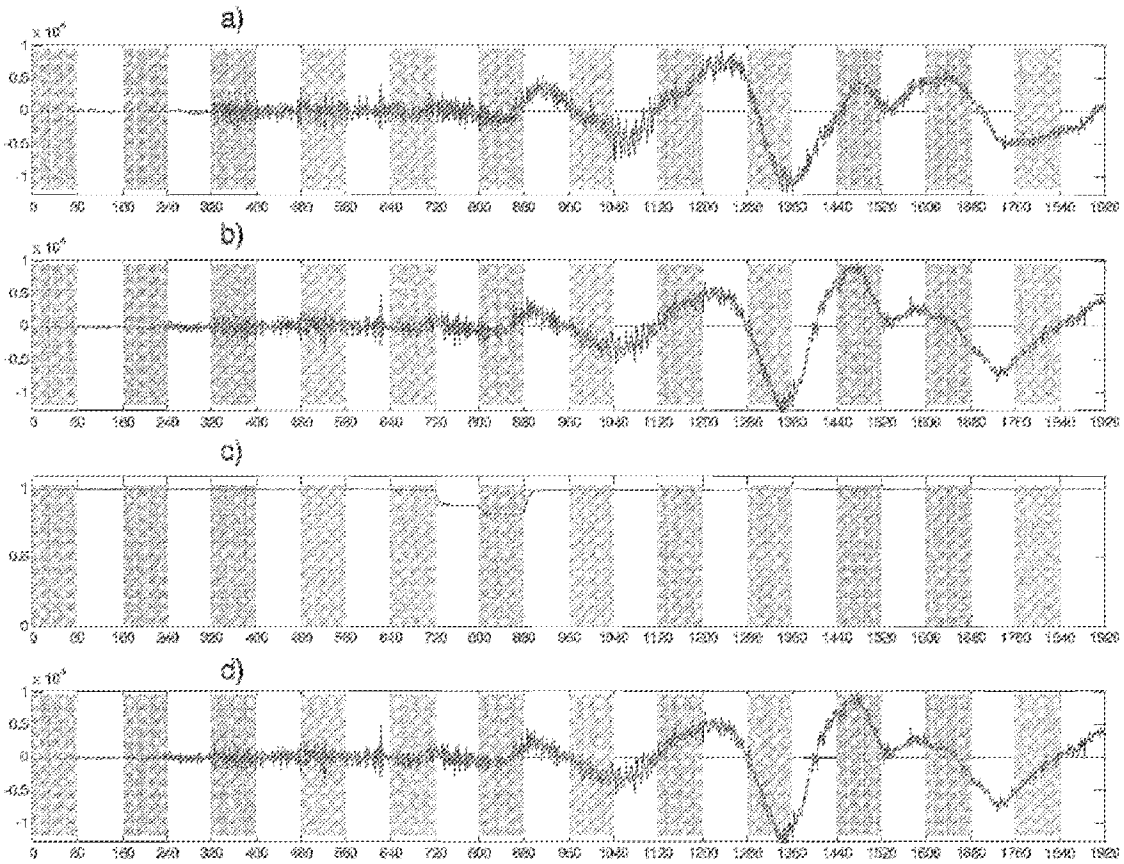
FIG. 10 illustrates an exemplary signal exhibiting high-frequency components at the origin for which a scheme for attenuating pre-echoes according to the prior art is implemented.

Indeed, there exist cases like that illustrated for example in FIG. 10 where it is preferable not to apply such a filtering in the pre-echo zone.

Indeed, in the rarer case illustrated in FIG. 10, part a) the high frequencies are already present in the signal to be coded. In this case the attenuation of the high frequencies could cause an audible degradation that must therefore be avoided. In this exemplary signal, it is observed that the attack is less abrupt than in the previous examples.

It is then beneficial to determine at least one parameter which makes it possible to decide whether it is necessary to spectrally shape the zone of the signal containing a pre-echo, by attenuating (or not) the high frequencies.

In an exemplary embodiment, this decision parameter is representative of the presence of high-frequency components in the pre-echo zone.

This parameter may be for example a measurement of the strength of the attack (abrupt or not). If the attack is located in sub-block number k, the parameter may be calculated as:

$$P = \frac{\max(En(k), En(k+1)}{\min(En(k-1), En(k-2))}$$

where k the number of the sub-block and En(k) the energy in the k-th sub-block.

According to an experimental setting, in this exemplary embodiment, P>=32 indicates an abrupt attack (very impulsive).

The measurement of strength of the attack can be supplemented by also taking account of the attenuation determined for the sub-block preceding the attack g(k−1). An attack can be considered to be abrupt if this attenuation is appreciable, for example if g(k−1)≤0.5. This shows that the energy in the pre-echo zone is considerably increased (more than doubled) because of the pre-echo, thus also signaling an abrupt attack.

If P<32 and g(k−1)>0.5, where k is the index of the sub-block containing the start of the attack, the filtering is not necessary. Indeed, if g(k−1)>0.5, $\lim_g(k)>0.5$, thereby signifying that the pre-echo zone has energy comparable with that of the previous frame and since the attack which generates the pre-echo is not abrupt, the risk of having an annoying spurious component is low.

Thus, in this embodiment with the conditions (P<32 and g(k−1)>0.5), no filtering will be carried out on the pre-echo zone.

In the other cases (g(k−1)≤0.5 or P>32) the spectral shaping filter is applied, according to the invention, from the start of the current frame up as far as the position $_{pos}$ of position of the attack.

In the exemplary embodiment described hereinabove the spectral shaping of the pre-echo zone by filtering according to the invention is adaptive as a function of the parameter P and of the attenuation values. Thus, the filtering is either applied with coefficients [0.25, 0.5, 0.25], or deactivated with coefficients [0, 1, 0].

The adaptation of the filtering coefficients is then performed in a discrete manner limited to a predefined set of values.

The adaptation of the filtering coefficients (making it possible to adapt the level of attenuation of the high frequencies) is therefore determined by decision parameters which measure the strength of the attack like the parameters P and g(k−1).

In this case this entails an adaptation of the coefficients of the filter in a discrete manner following two sets of possible values ([0.25, 0.5, 0.25] or [0, 1, 0]). It may be noted that the set of coefficients [0, 1, 0] corresponds to deactivation of the filtering.

A progressive transition between these two filters can be performed by also using for example the intermediate filters with coefficient [0.05, 0.9, 0.05], [0.1, 0.8, 0.1], [0.15, 0.7, 0.15] and [0.2, 0.6, 0.2].

In this case this entails an adaptation of the coefficients of the filter in a discrete manner following several sets of possible values, if the slow variation (or interpolation) is taken into account.

In variant embodiments, other interpolation schemes can be used.

For example, the filtering can be still more finely adaptive with c(n)=f(P) for example by using an intermediate filter with c(n)=[0.15, 0.7, 0.15] if 16<P<32. c(n) can also be calculated in a continuous manner as a function of P, for example with the formula $$c(n) = \frac{\arctan(P/10)}{2\pi}$$

In this case this entails an adaptation of the coefficients of the filter in a continuous manner according to the possible values where c(n) is in the interval [0, 0.25].

Other decision parameters can also be used in the decision of the choice and of the adaptation of the filter, such as for example the zero-crossing rate of the decoded signal of the pre-echo zone of the current frame and/or of the previous frame. The zero-crossing rate can be calculated in the following manner if we consider the zone n=0, . . . , L−1 by way of example:

$$zc = \frac{1}{2}\sum_{n=0}^{L-1} |\mathrm{sgn}[x_{rec,g}(n-1)] - \mathrm{sgn}[x_{rec,g}(n)]|$$

where $$\mathrm{sgn}(x) = \begin{cases} 1 & \text{if } x \geq 0 \\ -1 & \text{if } x < 0 \end{cases}$$

Indeed, a high zero-crossing rate zc in the previous frame (therefore without pre-echo) signals the presence of high frequencies in the signal. In this case, for example when zc>L/2 on the previous frame, it is preferable not to apply the filtering $c(n)z^{-1}+(1-2c(n))+c(n)z$.

In order to eliminate the bias of the continuous component, a prefiltering of the decoded signal is also possible before calculating the zero-crossing rate, or else the number of zero crossings of the estimated derivative $x_{rec,g}(n)-x_{rec,g}(n-1)$ can be used.

In a variant, a spectral analysis of the signal can also be carried out to aid decision. For example, the spectral envelope in the MDCT domain arising from the MDCT coding/decoding can be utilized in the choice of the filter to be used, however this variant assumes that the MDCT analysis/synthesis windows are short enough for the local statistics of the signal before the attack to remain stable over the length of a window.

Alternatively, it will be possible to filter the signal in the pre-echo zone and in the past frame through a high-pass complementary filter like $-c(n)z^{-1}+(1-2c(n))-c(n)z$, with for example c(n)=0.25, and thereafter the value of c(n) will be chosen in such a way that the average energy of the filtered signals in the pre-echo zone and on the past frame are as close as possible; the choice of c(n) will be able to be made over a limited set of possible values shown in FIG. 7 or on the basis of the energy ratio (or of an equivalent quantity such as the square root of the energy) of the signal after high-pass filtering in the pre-echo zone and in the past frame.

Note that the high-pass filtering can also be implemented in an alternative manner by calculating the difference between the signal $x_{rec,g}(n)$ and the signal filtered by the low-pass filter $c(n)z^{-1}+(1-2\,c(n))+c(n)z$ when c(n)=0.25.

In another variant, when the shaping filtering is of the type $c(n)z^{-1}+(1-c(n))$, it will be possible to fix the value of c(n) as a function of the prediction coefficient $-r(1)/r(0)$ arising from an analysis by linear prediction (LPC for "Linear Predictive Coding") to order 1 of the signal in the pre-echo zone and of the signal in the past frame.

In all these last variants (zero-crossing rate, MDCT spectral envelope, high-pass filtering, LPC analysis), the decision parameter regarding the filtering to be applied to the pre-echo zone is based on a spectral distribution analysis of the signal of the pre-echo zone and/or of the signal preceding the pre-echo zone; if the signal preceding the pre-echo zone already contains many high frequencies or if the quantity of the high frequencies of the signal in the pre-echo zone and of the signal preceding the pre-echo zone is substantially identical, the filtering according to the invention is not necessary and may even cause a slight degradation. In these cases it is necessary to deactivate or attenuate the filtering according to the invention by fixing c(n) at 0 or at a low value close to 0.

In a variant of the invention it will be possible to reverse the order between the attenuation and filtering step.

It may indeed be that the spectral shaping filtering (F) is carried out before the attenuation (Att.). Thus, after having performed the adaptive filtering of the samples of the pre-echo zone of the reconstructed signal of the current frame, these samples are then weighted by multiplying each sample by the previously calculated corresponding attenuation factor:

$$x_{rec,f,g}(n)=g_{pre}(n)x_{rec,f}(n), n=0, \ldots, L-11$$

The attenuation of the amplitudes can also be combined (or integrated) by defining a set of "joint" filter coefficients, for example if for sample n the filter has coefficients [c(n), 1−2c(n), c(n)] and the attenuation factor is g(n), then the filter $[g_{pre}(n)\ c(n),\ g_{pre}(n)2g_{pre}(n)c(n),\ g_{pre}(n)c(n)]$ can be used directly.

Figure 11:
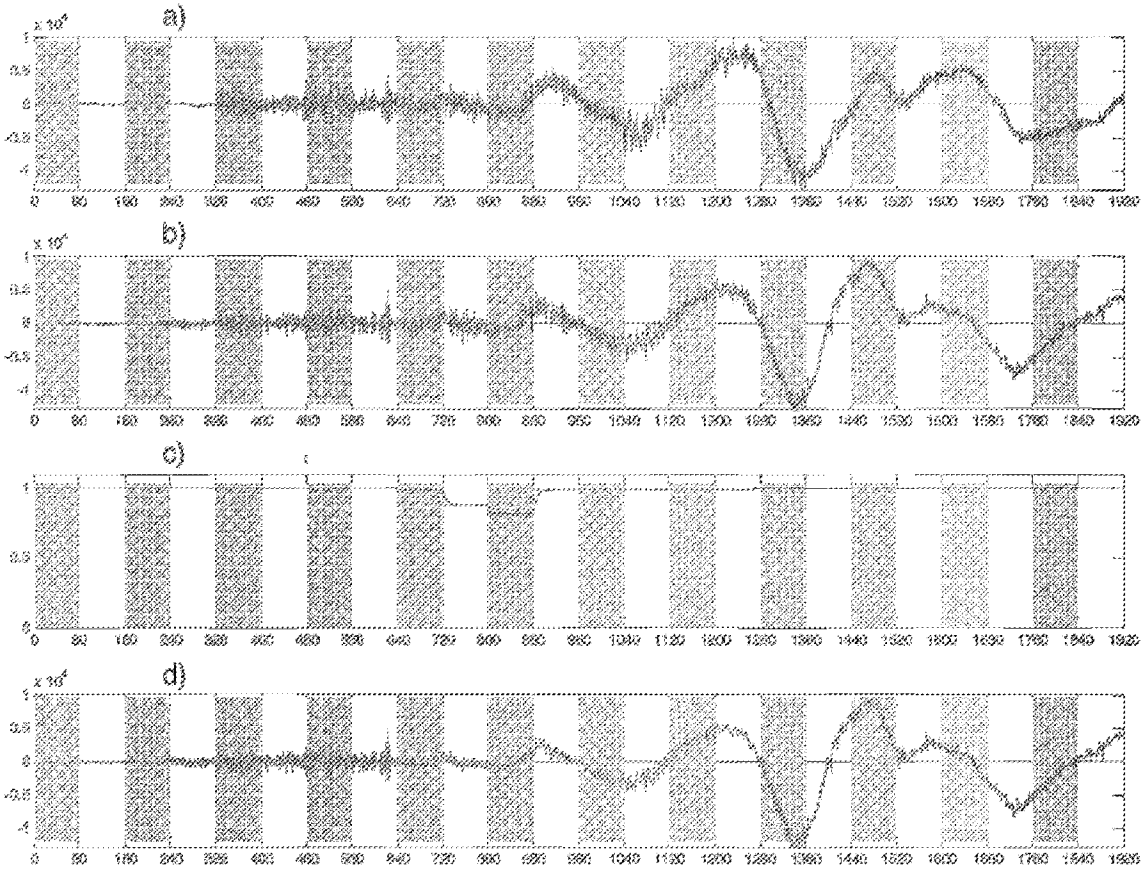
FIG. 11 illustrates the same signal as FIG. 11, exhibiting high-frequency components at the origin for which the processing according to the invention has been implemented without taking into account a criterion for deciding the filtering level to be applied.

FIG. 11 illustrates the advantage of rendering the filtering adaptive. It depicts the same signals parts a), b) and c) as FIG. 10 and illustrates the fact that the implementation of the non-adaptive filtering represented in part d) needlessly modifies the signal in the case where the high-frequency components are already present in the signal to be coded. It is observed that onwards of sample 640 the high frequencies are needlessly attenuated, this possibly effecting a slight degradation of quality. The use of an adaptive filtering as described hereinabove makes it possible to inhibit or to attenuate the filtering under these conditions, to not remove high frequencies already present in the signal to be coded and to thus avoid possible degradation due to the filtering.

To return to FIG. 6, the attenuation processing device 600 as described is here included in a decoder comprising an inverse quantization ($Q^{-1}$) module 610 receiving a signal S, an inverse transform ($MDCT^{-1}$) module 620, a module 630 for reconstructing the signal by addition/overlap (add/lap) as described with reference to FIG. 1 and delivering a reconstructed signal to the attenuation processing device according to the invention.

At the output of the device 600, a processed signal Sa is provided in which a pre-echo attenuation has been performed. The processing performed has made it possible to improve the pre-echo attenuation by the attenuation, as the case may be, of the high-frequency components, in the pre-echo zone.

Figure 12:
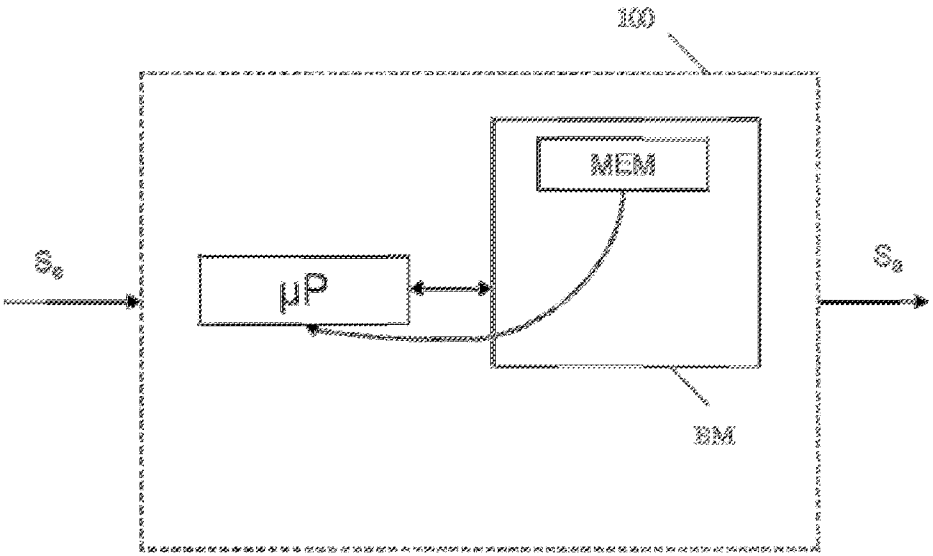
FIG. 12 illustrates a hardware example of an attenuation processing device according to the invention.

An exemplary embodiment of an attenuation processing device according to the invention is now described with reference to FIG. 12.

Hardware-wise, this device 100 within the meaning of the invention typically comprises a processor μP cooperating with a memory block BM including a storage and/or work memory, as well as an aforementioned buffer memory MEM in the guise of means for storing all data necessary for the implementation of the attenuation processing method as described with reference to FIG. 6. This device receives as input successive frames of the digital signal Se and delivers the signal Sa reconstructed with pre-echo attenuation and spectral shaping filtering, as the case may be.

The memory block BM can comprise a computational program comprising the code instructions for implementing the steps of the method according to the invention when these instructions are executed by a processor μP of the device and especially a step of detecting an attack position in the decoded signal, of determining a pre-echo zone preceding the attack position detected in the decoded signal, of calculating attenuation factors per sub-block of the pre-echo zone, as a function of the frame in which the attack has been detected and of the previous frame, of attenuating pre-echo in the sub-blocks of the pre-echo zone by the corresponding attenuation factors and furthermore, a step of applying a filtering for spectral shaping of the pre-echo zone on the current frame until as far as the detected position of the attack. FIG. 6 can illustrate the algorithm of such a computational program.

This attenuation device according to the invention can be independent or integrated into a digital signal decoder.

The invention claimed is:

1. A method of processing attenuation of pre-echo in a digital audio signal engendered on the basis of a transform-based coding, wherein the method comprises the following acts performed by a processing device:

receiving a decoded signal from a decoder device that has decoded the digital audio signal into the decoded signal;

detection of an attack position in the decoded signal;

determination of a pre-echo zone preceding the attack position detected in the decoded signal;

calculation of attenuation factors per sub-block of the pre-echo zone, as a function at least of a frame of the decoded digital signal in which the attack has been detected and of a previous frame of the decoded digital signal;

attenuation of pre-echo in the sub-blocks of the pre-echo zone by the corresponding attenuation factors; and application of filtering of spectral shaping of the pre-echo zone on the current frame until as far as the detected position of the attack to produce a processed signal in which the pre-echo attenuation has been performed, the filtering being a zero-phase finite impulse response filtering with transfer function:

$$c(n)z^{-1}+(1-2c(n))+c(n)z.$$

2. The method as claimed in claim 1, wherein the filtering of spectral shaping is an adaptive filtering and wherein the filtering furthermore comprises calculation of at least one decision parameter regarding the filtering to be applied to the pre-echo zone and the adaptation of the coefficients of the filtering as a function of said at least one decision parameter.

3. The method as claimed in claim 2, wherein at least one decision parameter is a measurement of the strength of the detected attack.

4. The method as claimed in claim 2, wherein at least one decision parameter is the value of the attenuation factor in the sub-block preceding that containing the position of the attack.

5. The method as claimed in claim 2, wherein at least one decision parameter is based on a spectral distribution analysis of the signal of the pre-echo zone and/or of the signal preceding the pre-echo zone.

6. The method as claimed in claim 3, wherein the measurement of the strength of the detected attack is of the form:

P=max (EN(k), EN (k+1)/min(EN(k−1),EN(k−2)) with k, the number of the sub-block in which the attack has been detected and EN(k) the energy of the $k^{th}$ sub-block.

7. The method as claimed in claim 2, wherein the adaptation of the coefficients of the filtering is performed in a discrete manner as a function of the comparison of at least one decision parameter with a predetermined threshold.

8. The method as claimed in claim 2, wherein the adaptation of the coefficients of the filtering is performed in a continuous manner as a function of said at least one decision parameter.

9. The method as claimed in claim 1, wherein the attenuation is performed at the same time as the spectral shaping filtering by integrating the attenuation factors into the coefficients defining the filtering.

10. A device for processing attenuation of pre-echo in a digital audio signal engendered on the basis of a transform-based coder, in which; the device comprises:

an input receiving a decoded signal from a decoder device that has decoded the digital audio signal into the decoded signal;

a detection module configured to detect an attack position in the decoded signal;

a determination module configured to determine a pre-echo zone preceding the attack position detected in the decoded signal;

a calculation module configured to calculate attenuation factors per sub-block of the pre-echo zone, as a function at least of a frame of the decoded digital signal in which the attack has been detected and of a previous frame of the decoded digital signal;

an attenuation module configured to attenuate the pre-echoes in the sub-blocks of the pre-echo zone by the corresponding attenuation factors; and filtering module configured to perform a spectral shaping of the pre-echo zone on the current frame until as far as the detected position of the attack to produce a processed signal in which the pre-echo attenuation has been performed, the filtering being a zero-phase finite impulse response filtering with transfer function:

$$c(n)z^{-1}+(1-2c(n))+c(n)z$$

an output providing the processed signal.

11. A decoder device of a digital audio signal comprising the device for processing as claimed in claim 10.

12. A non-transitory computer-readable medium comprising a computational program stored thereon and comprising code instructions for implementing a method of processing attenuation of pre-echo in a digital audio signal engendered on the basis of a transform-based coding, when these instructions are executed by a processor, wherein the method comprises the following acts performed by the processor as configured by the instructions:

receiving a decoded signal from a decoder device that has decoded the digital audio signal into the decoded signal;

detection of an attack position in the decoded signal;

determination of a pre-echo zone preceding the attack position detected in the decoded signal;

calculation of attenuation factors per sub-block of the pre-echo zone, as a function at least of a frame of the decoded digital signal in which the attack has been detected and of a previous frame of the decoded digital signal;

attenuation of pre-echo in the sub-blocks of the pre-echo zone by the corresponding attenuation factors; and application of a filtering of spectral shaping of the pre-echo zone on the current frame until as far as the detected position of the attack to produce a processed signal in which the pre-echo attenuation has been performed, the filtering being a zero-phase finite impulse response filtering with transfer function:

$$c(n)z^{-1}+(1-2c(n))+c(n)z.$$

* * * * *